US009512537B2

(12) United States Patent
Curran et al.

(10) Patent No.: US 9,512,537 B2
(45) Date of Patent: Dec. 6, 2016

(54) INTERFERENCE COLORING OF THICK, POROUS, OXIDE FILMS

(71) Applicant: Apple Inc., Cupertino, CA (US)

(72) Inventors: James A. Curran, Morgan Hill, CA (US); Sean R. Novak, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/312,502

(22) Filed: Jun. 23, 2014

(65) Prior Publication Data

US 2015/0368823 A1 Dec. 24, 2015

Related U.S. Application Data

(63) Continuation of application No. PCT/US2014/043601, filed on Jun. 23, 2014.

(51) Int. Cl.

| | |
|---|---|
| ***C25D 11/14*** | (2006.01) |
| ***C25D 9/00*** | (2006.01) |
| ***C25D 11/26*** | (2006.01) |
| ***C25D 11/08*** | (2006.01) |
| ***C25D 11/10*** | (2006.01) |
| ***C25D 11/16*** | (2006.01) |
| ***C25D 11/22*** | (2006.01) |
| *C25D 11/12* | (2006.01) |
| *C25D 11/24* | (2006.01) |
| *C25D 11/30* | (2006.01) |
| *C25D 11/34* | (2006.01) |

(52) U.S. Cl.

CPC ..... *C25D 11/26* (2013.01); *C25D 11/08* (2013.01); *C25D 11/10* (2013.01); *C25D 11/16* (2013.01); *C25D 11/22* (2013.01); *C25D 11/12* (2013.01); *C25D 11/246* (2013.01); *C25D 11/30* (2013.01); *C25D 11/34* (2013.01)

(58) Field of Classification Search

None

See application file for complete search history.

(56) References Cited

U.S. PATENT DOCUMENTS

| | | |
|---|---|---|
| 4,066,816 A | 1/1978 | Sheasby et al. |
| 4,310,586 A | 1/1982 | Sheasby et al. |

(Continued)

OTHER PUBLICATIONS

C. Grubbs. Anodizing of Aluminum. Metal Finishing, Jan. 2001, p. 476-493.*

(Continued)

*Primary Examiner* — Vera Katz

(74) *Attorney, Agent, or Firm* — Downey Brand LLP

(57) ABSTRACT

Porous metal oxide layers having a color due to visible light interference effects are disclosed. In particular embodiments the porous metal oxide layers are formed using an anodizing processes, which includes a porous metal oxide layer forming process and a barrier layer thickening process. The barrier layer thickening process increases a thickness of a barrier layer within the porous metal oxide layer to a thickness sufficient to and cause incident visible light waves to be reflected in the form of a new visible light waves, thereby imparting a color to the porous metal oxide layer. Methods for tuning the color of the porous metal oxide layer and for color matching surfaces of different types of metal substrates are described.

13 Claims, 8 Drawing Sheets

(56) References Cited

U.S. PATENT DOCUMENTS

| | | | | |
|---|---|---|---|---|
| 4,606,796 | A * | 8/1986 | Hanazima | C25D 11/18 205/174 |
| 4,687,551 | A | 8/1987 | Furneaux et al. | |
| 4,702,955 | A | 10/1987 | Allred et al. | |
| 4,773,717 | A | 9/1988 | Pai et al. | |
| 5,218,472 | A | 6/1993 | Jozefowicz et al. | |
| 6,027,629 | A * | 2/2000 | Hisamoto | B01J 3/006 205/172 |
| 7,922,889 | B2 * | 4/2011 | Critchlow | C25D 11/08 205/324 |
| 8,828,553 | B2 * | 9/2014 | Khosla | C25D 5/02 205/118 |
| 2005/0221712 | A1 * | 10/2005 | Yasui | H01J 9/025 445/50 |
| 2008/0213618 | A1 * | 9/2008 | Critchlow | C25D 11/08 428/613 |
| 2013/0153429 | A1 * | 6/2013 | Khosla | C25D 5/02 205/50 |

OTHER PUBLICATIONS

PCT/US2014/043601 International Search Report & Written Opinion dated Apr. 29, 2015.

Gils. S. V. et al., "Colour properties of barrier anodic oxide films on aluminum and titanium studied with total reflextance and spectroscopic ellipsometry." Surface & Coatings Technology, vol. 185, pp. 303-310 (2004).

Shih, T. S. et al., "Optical properties of anodic aluminum oxide films on A11050 alloys," Surface & Coatings Technology, vol. 202, pp. 3298 3305 (2008).

* cited by examiner

INTERFERENCE COLORING OF THICK, POROUS, OXIDE FILMS

CROSS REFERENCE TO RELATED APPLICATIONS

This application is a continuation of International Application No. PCT/US2014/043601, with an international filing date of Jun. 23, 2014, entitled "INTERFERENCE COLORING OF THICK, POROUS OXIDE FILMS", which is incorporated herein by reference in its entirety.

FIELD

This disclosure relates generally to metal oxide films and methods for forming the same. In particular, methods for preparing colored metal oxide films are described.

BACKGROUND

Aluminum material is available in a number of different alloys that have a wide range of different properties. In particular, different aluminum alloys can have different densities, tensile strengths, harnesses, corrosion resistances and other physical properties that are suitable for different applications. For example, a 2000 series aluminum alloys generally have good strength-to-weight ratios and good machinability and are therefore often used to form rivets and fasteners or foundations of aluminum aircraft. 6000 series aluminum alloys generally have good corrosion resistance and are used in many industrial commercial products.

Aluminum alloys include a number of different non-aluminum elements in differing amounts depending upon the type of alloys. Typical non-aluminum elements include iron, copper, manganese, chromium, silicon and others. These non-aluminum elements contribute to the differing physical properties of the aluminum alloys. The non-aluminum elements can also contribute differing cosmetic qualities, such as color, to different aluminum alloys. The different colors can make it difficult to match the colors of different aluminum alloy parts or match the colors of different portions of an aluminum part having different aluminum alloy portions.

SUMMARY

This paper describes various embodiments that relate to methods of forming a porous metal oxide film that is characterized as having a color due to thin film interference effects. In addition to providing colored porous metal oxide films, the methods can be used to color match metal pieces made of different metals or metal alloys.

According to one embodiment, a method of forming a colored coating on a substrate is described. The method involves converting part of the substrate to a porous metal oxide layer that includes a porous portion having a number of pores with corresponding pore terminuses and a non-porous barrier layer portion having a thickness defined by the pore terminuses and an underlying metal surface. The method also involves increasing the thickness of the non-porous barrier layer portion to a final thickness sufficiently thick to cause visible light waves incident the porous metal oxide layer to reflect off at least a portion of the pore terminuses and the underlying metal surface, interfere with each other and emerge from the porous metal oxide layer in the form of new visible light waves that give a color to the porous metal oxide layer.

According to another embodiment, a part is described. The part includes a metal substrate having a metal surface. The part also includes a porous metal oxide layer disposed on the metal surface. The porous metal oxide layer includes a porous portion having a number of pores with corresponding pore terminuses. The porous metal oxide layer also includes a non-porous barrier layer portion having a thickness defined by the pore terminuses and the metal surface. The thickness is sufficient to cause visible light waves incident the porous metal oxide layer to reflect off at least a portion of the pore terminuses and the metal surface, interfere with each other and emerge from the porous metal oxide layer in the form of new visible light waves that give a color to the porous metal oxide layer.

According to an additional embodiment, a method of color matching a first type of metal alloy with a second type of metal alloy is described. The method involves measuring a target color of an anodized surface of the first type of metal alloy. The method also involves measuring a subject color of an anodized surface of the second type of metal alloy different than the first type of metal alloy. The method additionally involves determining a color difference between the target color and the subject color. The method further involves forming a metal oxide layer on a part made of the second type of metal alloy based on the color difference. The metal oxide layer has a porous portion and a non-porous barrier layer portion having a thickness defined by a number of pore terminuses of the porous portion and an underlying metal surface. The non-porous barrier layer portion is sufficiently thick to cause visible light waves incident the metal oxide layer to reflect off at least a portion of the pore terminuses and the underlying metal surface, interfere with each other and emerge from the metal oxide layer in the form of new visible light waves that give a final color to the metal oxide layer substantially matching the target color.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
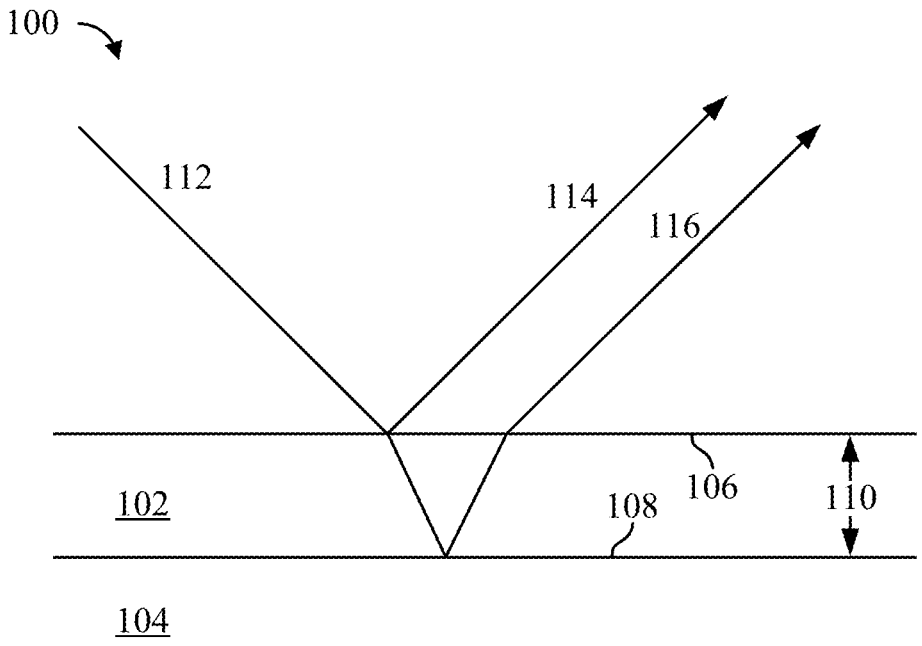
FIGS. 1A and 1B show cross-section views of two parts having metal oxide layers of different thicknesses demonstrating thin film interference.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

The following disclosure relates to metal oxide layers and method for forming metal oxide layers. Note that as used herein the terms "metal oxide layer" and "metal oxide film" are used interchangeably and refer generally to a metal oxide material having a thickness. The methods involve modifying a perceived color of a porous metal oxide layer by adjusting the thickness of a non-porous portion (sometimes referred to as a "barrier layer") of the porous metal oxide layer. The porous metal oxide layer also includes a porous portion disposed over and protecting the non-porous barrier layer portion from scratching and wearing and that is substantially transparent or translucent to visible light. The porous portion includes a number of pores having corresponding pore terminuses proximate the non-porous barrier layer portion. In this way, the non-porous barrier layer portion can be defined to have a thickness bounded by a series of pore terminuses of the porous portion on one side and by an underlying metal surface on another side. Certain thickness of the non-porous barrier layer portion can cause incoming light to interact with the pore terminuses and underlying metal surface in a way that gives the porous metal oxide layer a color. In particular, incident visible light waves enter the porous metal oxide layer, some of which reflect off at least a portion of the pore terminuses and the underlying metal surface, constructively and destructively interfere with each other, and emerge from the porous metal oxide layer having wavelengths that give the porous metal oxide layer an appearance of color.

The degree of constructive and destructive interference between incident visible light waves depends on the difference in the phases of the reflected light waves. Different degrees of constructive and destructive interference will result in producing different colors. The different degrees of interference, in turn, depend in part on a thickness of the non-porous barrier layer portion. Methods described herein can be used to adjust the thickness of the non-porous barrier layer and thereby tune the color of the porous metal oxide layer. For example, the methods can be used to provide colors such as yellow, magenta, green, blue and mixtures thereof to porous metal oxide layers. In some cases the colors provide a slight hue to the porous metal oxide layer. The porous metal oxide layer can also be partially translucent such that the underlying metal substrate can be seen, providing a colored metallic look.

Since the methods described herein can be used to provide a slight hue to a metallic surface, these methods can be used to color match different parts that have slightly different colors. In particular embodiments, the methods described are used to color match portions of a part made of different metals or to color match metal parts made of different metals. For example, in some applications, it may be advantageous to use a first type of alloy instead of a second type of alloy for reasons of structural strength, malleability or cosmetic appearance. However, depending on the composition of the alloys, the color of the finish of the first type of alloy can differ from the color of the finish of the second type of alloy. For example, the metal oxides of aluminum alloys that are rich in copper (copper-rich) can have a slightly yellow hue compared to the color of the metal oxides of aluminum alloys that are low in copper (copper-lean). According to some embodiments, a copper-rich aluminum alloy can correspond to some 6000 series aluminum alloys and a copper-lean aluminum alloy can correspond to some 7000 series aluminum alloys. This visible difference, even if slight, can make the copper-rich aluminum alloy part visibly distinguishable from the copper-lean aluminum alloy part, which can be undesirable in product lines where parts should visibly match. Methods described herein can be used to provide a color to a metal oxide of a first type of alloy (e.g., copper-rich aluminum alloy) such that the first type of alloy color matches a second type of aluminum alloy of significantly different alloying composition (e.g. copper-lean aluminum alloy). Note that the methods described can be applied to color match parts made of any types of metals or metal alloys having significantly different compositions and are not just limited to matching alloys classified under different alloy series. For example, the methods can also be used to color match two compositionally different alloys that both fall within the 6000 or 7000 series designation, but that differ significantly in copper or other elemental content such that they have visible color differences.

Methods described herein are well suited for providing cosmetically appealing surface finishes to consumer products. For example, the methods described herein can be used to form durable and cosmetically appealing finishes for housing for computers, portable electronic devices and electronic device accessories, such as those manufactured by Apple Inc., based in Cupertino, Calif.

These and other embodiments are discussed below with reference to FIGS. 1-7. However, those skilled in the art will readily appreciate that the detailed description given herein with respect to these Figures is for explanatory purposes only and should not be construed as limiting.

Figure 1B:
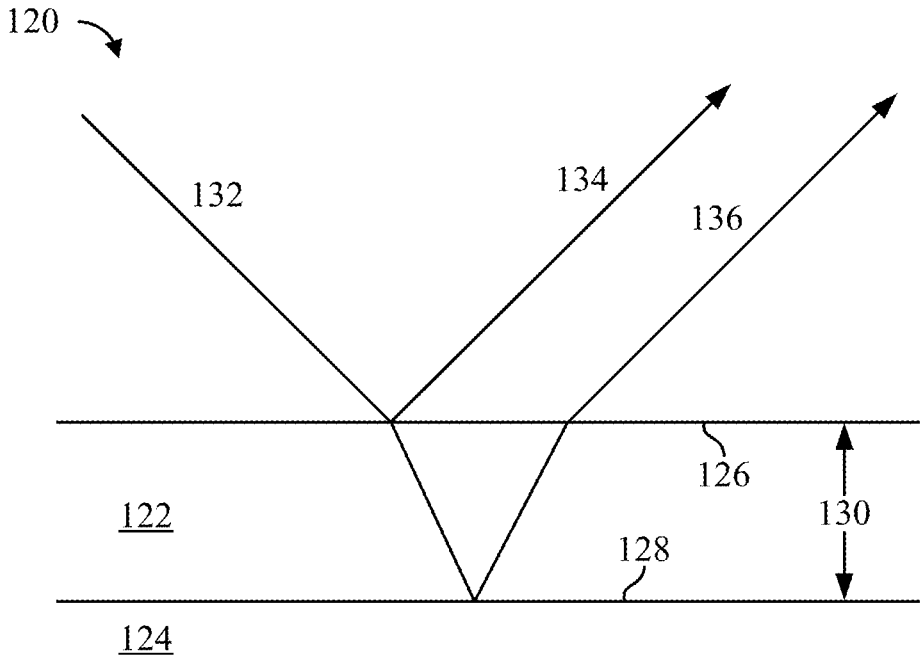

The appearance of thin layers of transparent or partially transparent material can be affected by what is known as thin film interference, which occurs when incident light waves are reflected by boundaries of the thin layer. In particular, thin film interference can cause a thin layer to appear colored. FIGS. 1A and 1B show cross-section views of two parts having metal oxide layers of different thicknesses demonstrating thin film interference. FIG. 1A shows part 100, which includes metal oxide layer 102, corresponding to a converted portion of metal substrate 104. Metal oxide layer 102 is at least partially transparent to visible light and has thickness 110 generally ranging in the tens or hundreds of nanometers scale. As such, metal oxide layer 102 has a thickness suitable for causing thin film interference. Metal oxide layer 102 can correspond to, for example an aluminum oxide layer or a titanium oxide layer.

Metal oxide layer 102 includes first surface 106, corresponding to an exterior surface of part 100, and second surface 108, corresponding to underlying surface of metal substrate 104. Metal oxide layer is exposed to incident light 112. A first portion of incident light 112 reflects off first surface 106 as reflected light 114. A second portion of incident light 112 enters metal oxide layer 102 at first surface 106, refracts at the interface, travels through metal oxide layer 102, reflects off of terminal surface 108, refracts at first surface 106 due to the change in medium, and exits metal oxide layer 102 as reflected light 116. The different paths that reflected light 114 and 116 take cause constructive and destructive interference between reflected light 114 and 116. The degree of constructive and destructive interference will depend upon differences in their phases. The difference in the phases, in turn, depends in part on the degree of thickness 110 of layer 102. This light interference can appear as a perceived color of metal oxide layer 102. Put another way, light waves 112 incident metal oxide layer 102 reflect off surfaces 106 and 108 causing the light waves to interfere with each other and exit metal oxide layer 102 in the form of new visible light waves 114 and 116 that give a color to the porous metal oxide layer. In addition to the degree of thickness 110, the perceived color of metal oxide layer 102 will depend, in part, on the type of material that metal oxide layer 102 is made. For example, typical colors for aluminum oxide layers can include yellow, pink, green, blue and variations thereof. Typical titanium oxide layer can include gold, purple, green, blue, magenta and variations thereof. In addition, the interference color observed with aluminum oxide layers are generally lighter in intensity compared to those observed on titanium oxide because of the relative strength of the reflection 116 from the metal, as compared to that from the oxide outer surface 114. With interference coloring of titanium, the reflected intensities are relatively well matched and resulting colors are generally more intense.

FIG. 1B shows part 120, which includes metal oxide layer 122, corresponding to a converted portion of metal substrate 124. Metal oxide layer 120 includes first surface 126, corresponding to an exterior surface of part 120, and second surface 128, corresponding to underlying surface of metal substrate 124. Like metal oxide layer 102 of FIG. 1A, metal oxide layer 122 is at least partially transparent to visible light and has a thickness 130 that generally ranges in the tens or hundreds of nanometers scale. However, metal oxide layer 122 has thickness 130 that is greater than thickness 110 of layer 102. A first portion of incident light 132 reflects off first surface 126 as reflected light 134. A second portion of incident light 132 enters metal oxide layer 120 at first surface 126, refracts at the interface, travels through metal oxide layer 120, reflects off of second surface 128, refracts at first surface 126 due to the change in medium, and exits metal oxide layer 120 as reflected light 136. As described above, the degree of constructive and destructive interference will depend, in part, on the degree of thickness 130 of metal oxide layer. Thus, the different thicknesses of metal oxide layers 102 and 120 can cause metal oxide layers 102 and 120 to have different colors.

One of the problems of using an interference colored thin metal oxide layer such as described above with reference to FIGS. 1A and 1B, is that the thin metal oxide layer may not be sufficiently thick to serve as a protective coating for many applications. For example, the thin metal oxide layer may have low scratch resistance and low wear resistance. Methods described herein combine the thin film interference properties of a thin non-porous metal oxide layer with the durability provided by a porous metal oxide to form a colored porous metal oxide layer.

Conventional techniques for coloring porous metal oxide layers include dyeing and electrocoloring. Dyeing typically involves depositing dyes, such as organic-based dyes, in the pores of a porous metal oxide layer and electrocoloring typically involves depositing metal within the pores of a porous metal oxide layer. These coloring techniques, however, can have disadvantages. For example, dyeing is difficult to control for very subtle color corrections. In addition, dyeing generally reduces the lightness (L*) of the color of the porous oxides because the presence of the dye reduces the intensity of reflections from the underlying metal substrate, making the metal finish less bright. Furthermore, durability with respect to surface abrasion is limited because dye uptake is predominantly in the outermost region of the porous oxide, making the dyed porous oxides susceptible to removal under surface abrasion or wear. Moreover, many dyed porous oxides can degrade under ultraviolet (UV) light. In the case of electrocoloring, the metal is generally deposited relatively thickly. The metal deposits thus tend to scatter most incident light within the porous metal oxide layer. Thus, only darker colors such as brown, bronze and black are generally achievable—based on the degree of scattering of light, combined with some overtones of the color of the deposited metal. For example, using copper as the deposited metal tends to yield a reddish-brown to a black color.

In what might be described as conventional interference coloring techniques, metals are also deposited within the pores, but generally at lower thicknesses such that an optical thin film interference coloring effect is manifested. In the conventional interference coloring techniques, the two effective planes of reflection correspond to the metal oxide/aluminum interface and the approximate plane formed by the tops of the metallic deposits in the pores. As with the electrocoloring, there tends to be an overtone corresponding to the metal that has been deposited in the pores. This skews the color range away from that of the underlying aluminum, making it unsuitable for the subtle color adjustment and matching such as described in the embodiments presented herein. Also, as with electrocoloring, some light is scattered and absorbed by the deposited metal, limiting the color range to colors with lower L* values. Furthermore, the thickness of the deposited metal is less uniform and much harder to control than that of the thickened barrier layer described in the embodiments presented herein, making the use of conventional interference coloring techniques more difficult to achieve precise color. That is, the less uniform thickness results in a metal oxide having a duller color. Moreover, the metallic deposits used in the conventional interference coloring techniques are susceptible to corrosion, oxidation and some degree of dissolution during processing, again, making it hard to control their thickness and uniformity or achieve reliable, precisely repeatable color results.

Methods described herein differ from conventional techniques in a number of ways. For example, the interference coloring techniques described herein can provide a color to a porous metal oxide layer without dyeing or electrocoloring. Thus, the color produced by the interference effects will be generally more precisely controllable compared to colors produced using conventional techniques, thereby providing more reliable and consistent coloring results. The colored oxide layers are also generally resistant to UV light fading and less susceptible to color loss from abrasion or wear. Furthermore, one can produce colored metal oxide films having subtle hue differences. In addition, methods described herein can be used to adjust the thickness of a barrier layer between the porous portion of the porous metal oxide layer and an underlying substrate, thereby providing accurate control of producing metal oxide layers having any of a number of different colors. These and other advantages are described herein.

Figure 2A:
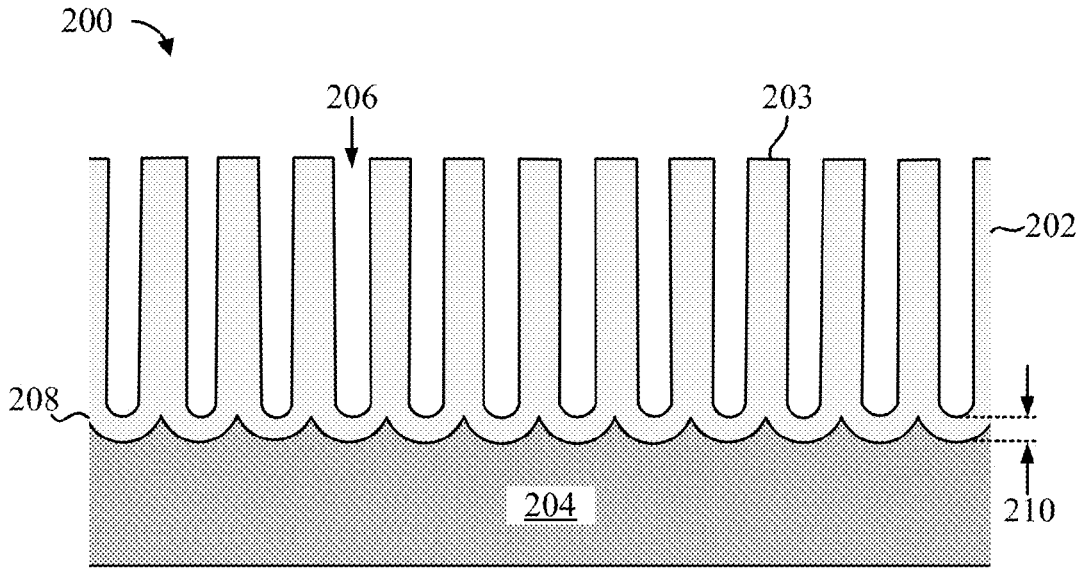
FIGS. 2A and 2B show cross section views of a part undergoing an interference coloring process in accordance with described embodiments.
Figure 2B:
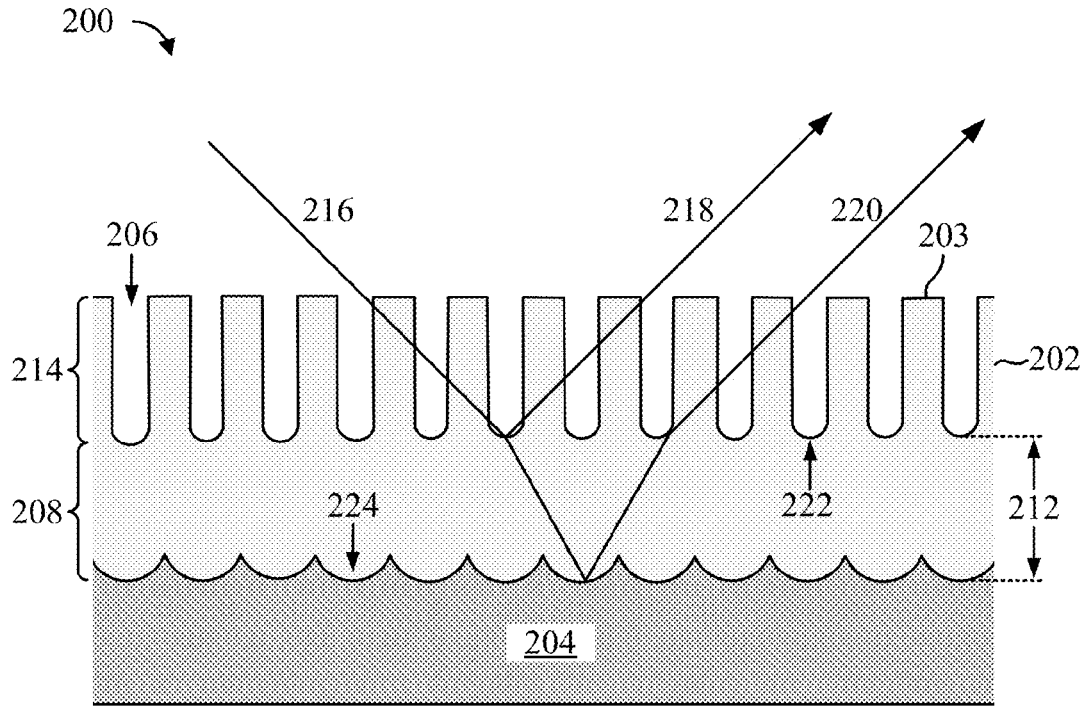

FIGS. 2A and 2B show cross section views of part 200 undergoing an interference coloring process in accordance with described embodiments. At FIG. 2A, a portion of metal substrate 204 is converted to porous metal oxide layer 202.

In some embodiments, an anodizing process is used to form porous metal oxide layer 202. In other embodiments, a thermal process is used to form porous metal oxide layer 202. Porous metal oxide layer 202 has pores 206 that are formed therein during, for example, an anodizing process. Substrate 204 can be made of any suitable anodizable material, including one or more of aluminum, titanium, zinc, magnesium, niobium, zirconium, hafnium, tantalum, and alloys thereof. In some embodiments, substrate 204 is made of an aluminum alloy, such as a suitable 2000, 3000, 4000, 5000, 6000 or 7000 series aluminum alloy. Prior to forming metal oxide layer 202, substrate can be treated to any of a number of suitable surface finishing operations, including one or more polishing and/or texturing (e.g., blasting and/or etching) processes. In some embodiments, substrate 204 is a housing or a portion of a housing for an electronic device.

Any suitable anodizing process for forming metal oxide layer 202 can be used. In some embodiments, an anodizing process that provides a thick enough metal oxide layer 202 for providing sufficient scratch and wear resistance to part 200 is used. In particular embodiments, an anodizing process using a sulfuric acid electrolytic bath is used. Anodizing processes that include other electrolytic baths, such as suitable phosphoric acid or oxalic acid electrolytic baths are used. The voltage can be DC, AC or a combination thereof. Metal oxide layer 202 is at least partially transparent to visible light incident first surface 203, corresponding to an exterior surface of part 200. In some embodiments, metal oxide layer 202 is substantially transparent, which means that substantially all incident visible light is allowed to transmit through metal oxide layer 202. In some embodiments, a transparent material allows around 90% of incident visible light to transmit through metal oxide layer 202. In other embodiments, metal oxide layer 202 is translucent but not completely transparent. Since at least some incident visible light is allowed to transmit through metal oxide layer 202, this transmitted light can reach and reflect off of underlying substrate 204. This equates to underlying substrate 204 being at least partially visible though metal oxide layer 202. That is, the metallic appearance of substrate 204 is at least partially visible through metal oxide layer 202. In addition any surface topology, such as shiny polished surface or textured surface, can at least partially viewable through metal oxide layer 202.

Barrier layer portion 208 of porous metal oxide layer 202 forms proximate substrate 204 at the terminuses of pores 206 during the anodizing process. Barrier layer portion 208 is generally a dense and consistent non-porous region of porous metal oxide layer 202. Barrier layer portion 208 is generally very thin, corresponding to thickness 210. Thickness 210 of barrier layer portion 208 can depend, in part, on the voltage used during the anodizing process. In some embodiments, an anodizing voltage ranging from about 15 volts and 30 volts is used, corresponding to thickness 210 from about 30 nm and 90 nm. Thickness 210 is generally too small to cause the interference coloring effects described above with respect to FIGS. 1A and 1B.

At FIG. 2B, part 200 is exposed to a non-dissolution anodizing process that promotes growth and thickening of barrier layer portion 208. As shown, barrier layer portion 208 has grown to thickness 212, which is substantially greater than thickness 210 prior to exposure to the non-dissolution anodizing process. Growth of barrier layer portion 208 is a self-limiting process such that barrier layer portion 208 generally grows uniformly. A non-dissolution anodizing process generally involves growth of a metal oxide layer without substantial simultaneous dissolution of the metal oxide layer. This is in contrast to dissolution anodizing processes, such the anodizing process used to form porous metal oxide layer 202 at FIG. 2A. Non-dissolution anodizing processes can involve the use of an electrolytic bath that promotes metal oxide growth without substantial dissolution and without substantial pore formation. In some embodiments, the electrolytic bath includes sodium borate ($NaB_4O_7.H_2O$), ammonium pentaborate, a neutral borate (e.g., boric acid+sodium tetraborate), dilute boric acid, diammonium tartrate (e.g. with pH adjusted with tartaric acid additions), sodium sulfate, ethylene glycol or other suitable non-dissolution anodizing agents. In particular embodiments, an electrolytic bath that includes sodium borate is preferably used. The temperature of the electrolytic bath and current density can vary depending on a number of process factors. In particular embodiments, the electrolytic bath temperature is around room temperature and current density ranges from about 0.2 $A/dm^2$ and 10 $A/dm^2$. Note that thickening of barrier layer portion 208 can occur before or even after an optional pore sealing process for sealing portions of pores 206 that are exposed at first surface 203.

Thickness 212 of barrier layer portion 208 is controlled by adjusting the voltage applied to the electrolytic bath during the non-dissolution anodizing process. In some embodiments, an anodizing voltage of greater than about 40 volts is used. In some embodiments, the anodizing voltage is between about 50 volts and 120 volts. In a particular embodiment, an anodizing voltage of between about 70-100 volts is used to form a barrier layer portion 208 having a corresponding thickness 212 between about 175-250 nm, corresponding to providing a bluish color to metal oxide layer 202. In another embodiment, an anodizing voltage of about 120-150 volts is used to form a barrier layer portion 208 having a thickness 212 of about 300-375 nm, corresponding to providing a yellowish color to metal oxide layer 202. In another embodiment, an anodizing voltage of about 200 volts is used to form a barrier layer portion 208 having a thickness 212 of about 500 nm, corresponding to providing a purplish-pink color to metal oxide layer 202. Methods described herein can be used to accurately tune the color of a metal oxide layer, which will be described in detail below with reference to FIGS. 5A-5B and 6.

When part 200 is exposed to incident visible light waves 216, incident visible light waves 216 reflect off at least a portion of the of pore terminuses 222 and underlying metal surface 224, interfere with each other and exit porous metal oxide layer 202 in the form of new visible light waves 218 and 220 that give a color to porous metal oxide layer 202. For instance, a first portion of incident light waves 216 enters first surface 203 of porous metal oxide layer 202, reflects off of pore terminuses 222 (i.e., terminus pore walls), and exits porous metal oxide layer 202 as reflected light waves 218. Note that a portion of incident light waves 216 may also refract off of first surface 203 of porous metal oxide layer 202 when entering and exiting porous metal oxide layer 202 but this is not shown for purpose of simplicity. A second portion of incident light waves 216 enters porous metal oxide layer 202 at first surface 203, travels through porous metal oxide layer 202, reflects off of substrate surface 224 and exits porous metal oxide layer 202 as reflected light waves 220. Note that the second portion can also refract off surfaces 222 (i.e., terminus pore walls) of pores 206 and first surface 203 due to the change in medium.

The different paths that light waves 218 and 220 take cause constructive and destructive interference between reflected light waves 218 and 220. The degree of constructive and destructive interference depends upon differences in their phases, which in turn depends on thickness 212 of non-porous barrier layer portion 208. Other factors that can determine the amount of constructive and destructive interference include the refractive index of porous portion 214 and non-porous barrier layer portion 208, and to a lesser degree the angle of incidence of incident light waves 216. This constructive and destructive interference manifests as an appearance of color to porous metal oxide layer 202. Since the thickness of barrier layer portion 208 is dependent on the voltage used during the non-dissolution anodizing process, one can give a predetermined color to porous metal oxide layer 202 by tuning the voltage used in thickening barrier layer portion 208. This will be described in detail below with respect to FIGS. 5A-5B and 6.

In some embodiments, the color imparted to porous metal oxide layer 202 is relatively subtle compared to porous metal oxide layer 202 without thickened barrier layer portion 208. The subtly of the color can depend, in part, on the material of substrate 204. For example, titanium and titanium alloy substrates generally produce more stark colors than aluminum and aluminum alloy substrates. This is in part because of the high reflectivity of aluminum metal, which can reduce the richness of the perceived color. In some embodiments, the subtle differences in color that can be accomplished with aluminum and aluminum alloys makes the methods described herein well suited for color matching purposes, which will be described in detail below with respect to FIG. 7.

Note that porous portion 214 of porous metal oxide layer 202 is positioned above barrier layer portion 208 thereby protecting barrier layer portion 208 from exposure to scratching and wear that part 200 may experience during normal use. In this way, porous metal oxide layer 202 is characterized as having a distinctive color produced by the thin film interference effects of thickened barrier layer portion 208 and good wear/scratch resistance provided by porous portion 214.

Figure 3A:
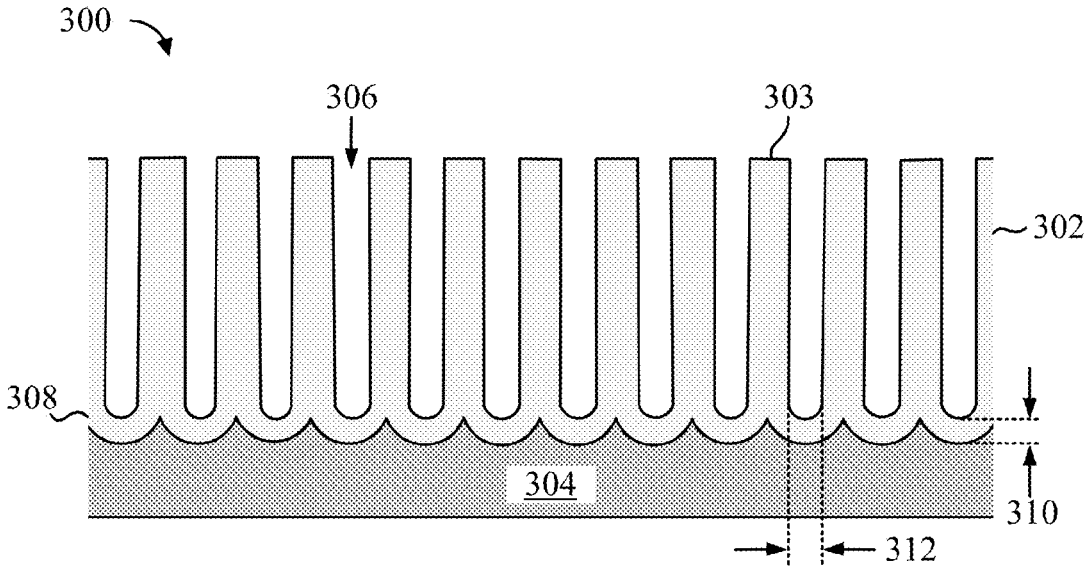
FIGS. 3A-3C show cross-section views of a part undergoing an interference coloring process that includes a pore modification process in accordance with described embodiments.
Figure 3B:
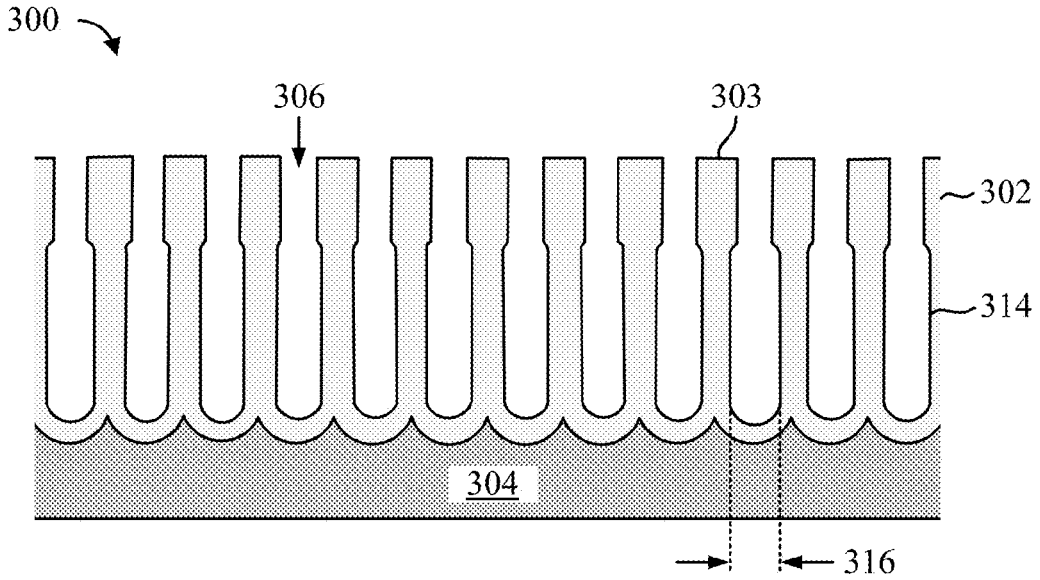
Figure 3C:
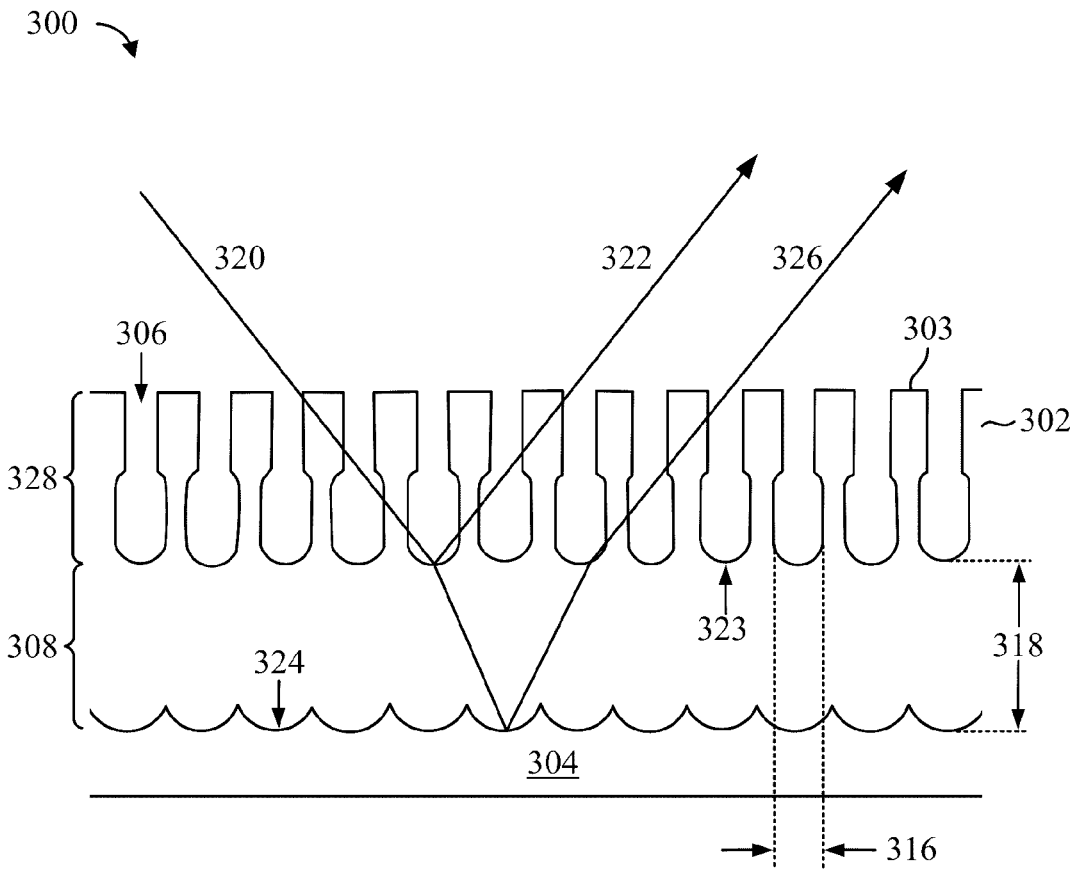

In some embodiments, the pores of a porous metal oxide layer can be modified in order to increase the amount of interference coloring. FIGS. 3A-3C show cross-section views of part 300 undergoing an interference coloring process that includes a pore modification process. At FIG. 3A, a portion of metal substrate 304 is converted to porous metal oxide layer 302 having pores 306. Porous metal oxide layer 302 can be formed using any suitable technique, including suitable anodizing processes described above with reference to FIG. 2A. Pores 306 have an average width (or diameter) 312. Substrate 304 can be made of any suitable anodizable material, such as one or more of aluminum, titanium, zinc, magnesium, niobium, zirconium, hafnium, tantalum, and alloys thereof. Prior to forming metal oxide layer 302, substrate can be treated to any of a number of suitable surface finishing operations, including one or more polishing and/or texturing (e.g., blasting and/or etching) processes.

Metal oxide layer 302 is at least partially transparent to visible light incident first surface 303, corresponding to an exterior surface of part 300. During the formation of porous metal oxide layer 302, barrier layer portion 308 forms proximate substrate 304 at the terminuses of pores 306 and has thickness 310 that is typically too thin to cause the interference coloring effects. As described above, thickness 310 of barrier layer 308 can depend, in part, on the voltage used during the anodizing process. In some embodiments, an anodizing voltage ranging from about 15 volts and 30 volts is used, corresponding to thickness 210 from about 30 nm and 90 nm.

At FIG. 3B, part 300 is exposed to a pore-widening process that expands at least the terminus portions 314 of pores 306. In some embodiments, this involves exposing part 300 to an anodizing process with phosphoric acid using a voltage ranging from about 5 volts and 15 volts. In a particular embodiment, a voltage of about 10 volts is used. In some embodiments, the pore-widening process occurs in the same electrolytic bath used to form metal oxide layer 302 but with different electrolytic conditions. In other embodiments, part 300 is transferred to a different electrolytic bath than that used to form metal oxide layer 302. The process parameters for the pore-widening anodizing process can vary depending on a number of factors such as the chemical nature of the electrolytic bath and the type of substrate 304. In some embodiments, the voltage is applied for between about 2 and 6 minutes. In a particular embodiment, the voltage is applied for about 4 minutes. The pore-widening process increases terminus portions 314 of pores 306 to an average width (or diameter) 316 that is larger than width 312 prior to the pore-widening process.

At FIG. 3C, part 300 is exposed to a non-dissolution anodizing process that promotes growth and thickening of barrier layer portion 308 to thickness 318, which is substantially greater than thickness 310 prior to exposure to the non-dissolution anodizing process. This non-dissolution anodizing process can be similar to the non-dissolution process described above with reference to FIG. 2B and can use an electrolytic bath including sodium borate, ammonium pentaborate, a neutral borate, dilute boric acid, diammonium tartrate, sodium sulfate, ethylene glycol or other suitable non-dissolution agents. Thickness 310 of barrier layer portion 308 is sufficiently thick so as to cause thin film interference effects. For example, a first portion of incident light waves 320 can enter first surface 303 of porous metal oxide layer 302, reflect off surfaces 323 (i.e., terminus pore walls) of pores 306 and exit porous metal oxide layer 302 as reflected light waves 322. A second portion of incident light waves 320 can enter metal oxide layer 302 at first surface 303, travel through porous metal oxide layer 302, reflect off of substrate surface 324 and exit porous metal oxide layer 302 as reflected light waves 326. Light waves 322 and 326 constructively and destructively interfere causing porous metal oxide layer 302 to take on a color. Porous portion 328 of porous metal oxide layer 302 is positioned above and protects barrier layer portion 308 from exposure to scratching and wear that part 300 may experience during normal use.

Since pores 306 are widened to have an average width 316 larger than width 312 prior to pore widening, the pore walls at the terminal surfaces 323 have more surface area for incident light waves 320 to reflect off of. This increases the amount of light reflected off of terminal surfaces 323 and, in turn, intensifies the perceived color of porous metal oxide layer 302. That is, one can increase the amount of reflected light and intensify the color of metal oxide layer 302 by increasing the surface area at the terminuses of pores 306. Another way to increase the surface area of the terminuses of pores 306 is by using a porous anodizing process (FIG. 3A) that creates pores having relatively large pore diameters. For example, standard sulfuric acid anodizing processes typically create pores with an average pore diameter ranging from about 20 nm and 40 nm, whereas phosphoric acid anodizing processes can create pores having an average pore diameter ranging from about 300 nm and 400 nm. Larger pore diameters can equate to larger amounts of reflective surface area at the terminuses of the pores, thereby increasing the intensity of the color of the porous metal oxide layer.

In some embodiments, methods used to create wide pores (e.g., phosphoric acid anodizing) and pore widening processes are used in combination. However, factors such as the durability should be weighed in when designing the anodizing and/or pore-widening processes. For example, a porous metal oxide layer having too much porosity may not be durable enough for certain applications.

Figure 4:
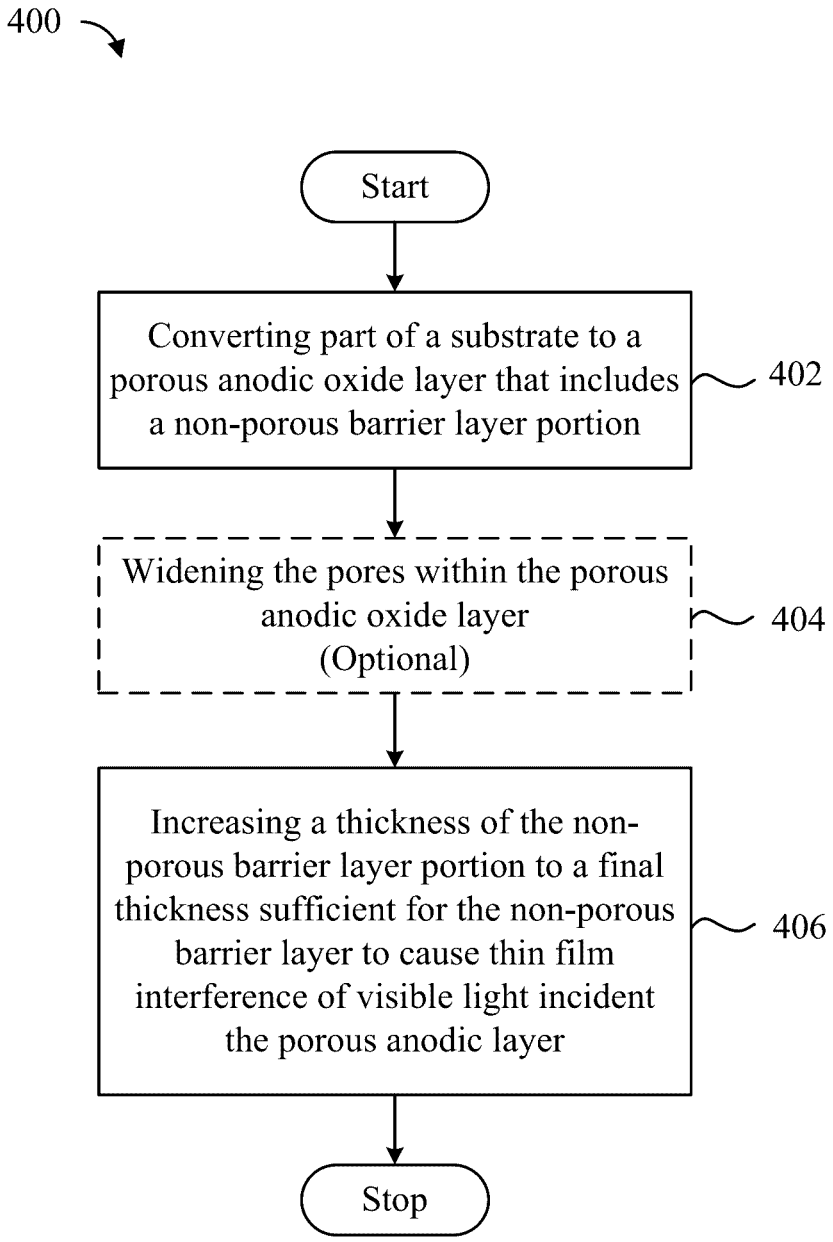
FIG. 4 shows a flowchart indicating a process for forming an interference colored porous metal oxide layer on a substrate in accordance with FIGS. 2A-2B and 3A-3C.

FIG. 4 shows flowchart 400 indicating a process for forming an interference colored porous metal oxide layer on a substrate in accordance with FIGS. 2A-2B and 3A-3C described above. At 402, part of a substrate is converted to a porous metal oxide layer that includes a non-porous barrier layer portion. As described above, the substrate can include one or more anodizable materials, such as aluminum and/or titanium. In some embodiments, the substrate includes an aluminum alloy. In some embodiments, the conversion involves exposing the substrate to any anodizing process suitable for forming pores within the resultant metal oxide layer. In some embodiments, the anodizing process involves using an electrolytic bath including one or more of sulfuric acid, phosphoric acid and oxalic acid. The porous metal oxide layer should be at least partially transparent to visible light. In some embodiments, prior to anodizing, the substrate is exposed to one or more surface finishing operation, such as one or more polishing, etching and blasting operations, forming a finished surface that is exposed to the anodizing process.

At 404, the pores within the porous metal oxide layer are optionally widened. This can be achieved by exposing the porous metal oxide layer to a pore-widening anodizing process, such as a phosphoric acid or oxalic acid anodizing process. In some embodiments the pore-widening process occurs in the same electrolytic bath as the anodizing process used to form the porous metal oxide layer. This may be achieved by increasing the applied voltage or current density. The pore-widening process increases the terminal surfaces of the pores, thereby creating more internal surfaces for reflecting incident light and intensifying a perceived color of the porous metal oxide layer after thickening of the non-porous barrier layer (406).

At 406, a thickness of the non-porous barrier layer portion of the porous metal oxide layer is increased to a final thickness. In some embodiments, this involves exposing the part to a non-dissolution anodizing process whereby growth of the non-porous barrier layer portion is promoted without substantial formation of pores. In some embodiments, the non-dissolution anodizing process involves the use of a non-dissolution electrolytic bath, such as an electrolytic bath that includes sodium borate, ammonium pentaborate, a neutral borate, dilute boric acid, diammonium tartrate, sodium sulfate, ethylene glycol or other suitable non-dissolution anodizing agents.

The final thickness of the non-porous barrier layer portion is sufficiently thick for the non-porous barrier layer portion to cause thin film interference of visible light incident the porous metal oxide layer. That is, visible light waves incident an exposed surface of the porous metal oxide layer reflect off at least a portion of the pore terminuses and the underlying metal surface, interfere with each other and exit the porous metal oxide layer in the form of new visible light waves that give a color to the porous metal oxide layer. If a pore-widening process (404) is used, the resultant color may be intensified by the presence of more reflective surfaces provided by the widened pore terminus walls.

Figure 5A:
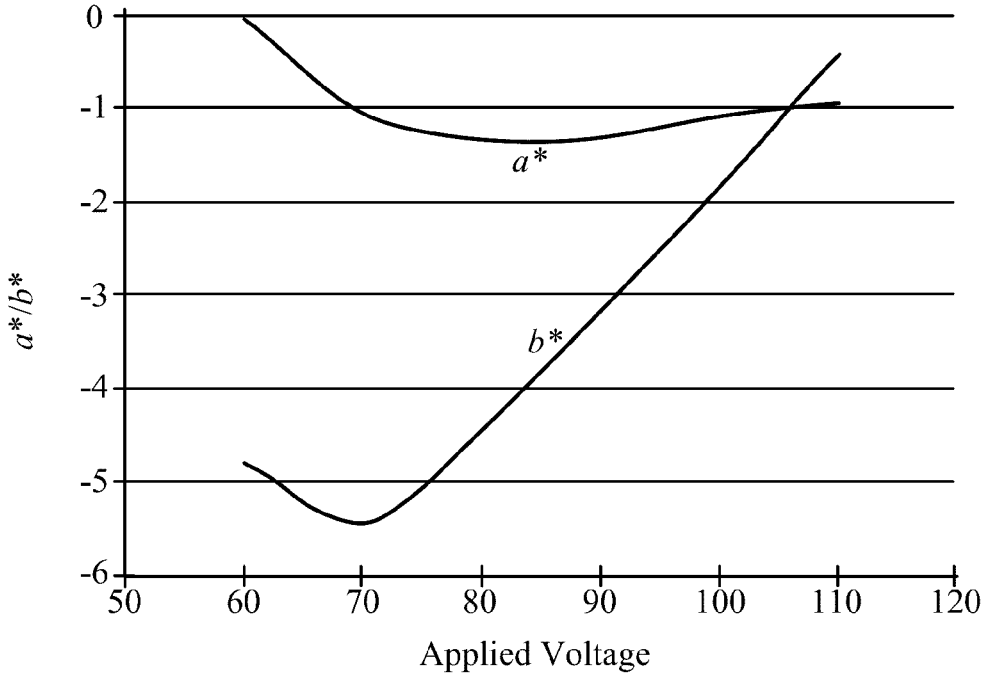
FIGS. 5A and 5B show L* a* b* color space plots indicating how applied voltage can effect a* and b* color opponent dimension values for an interference colored porous aluminum oxide layer formed from an aluminum alloy substrate.
Figure 5B:
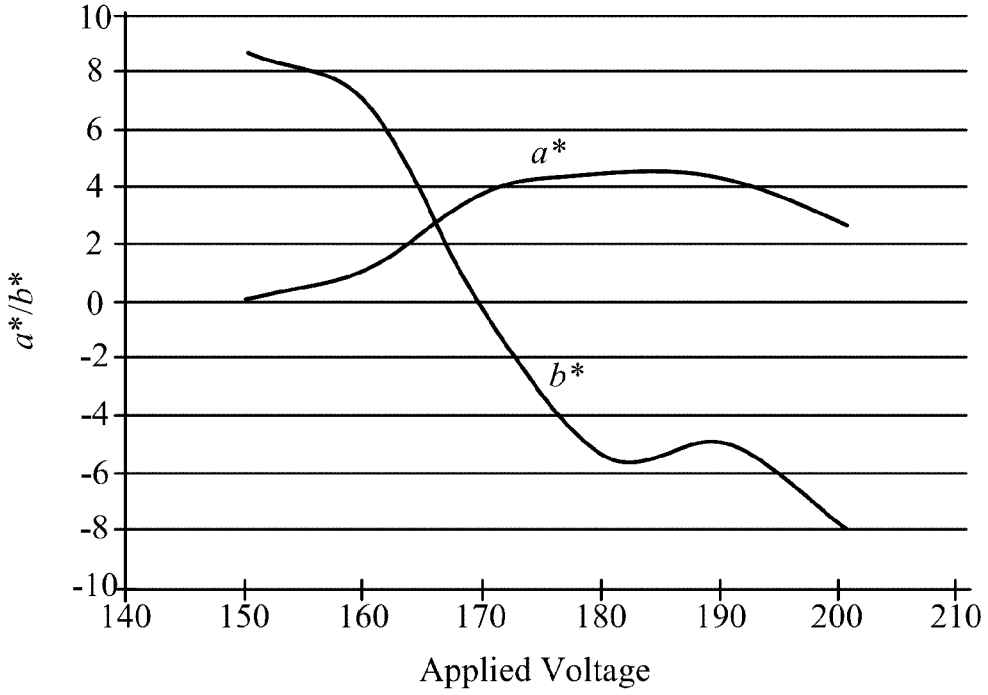

As described above, tuning the thickness of the barrier layer portion of the porous metal oxide layer can control the color of a porous metal oxide layer. Furthermore, the thickness of the barrier layer portion is directly related to the voltage applied during the non-dissolution anodizing process. FIGS. 5A and 5B show plots indicating how applied voltage can effect a* and b* color opponent dimension values in L*a*b* color space (or CIELAB) for an interference colored porous aluminum oxide layer formed from an aluminum alloy substrate. In general, L*a*b* color space is a model used to plot colors of an object according to color opponents L* corresponding to an amount of lightness, a* corresponding to amounts of green and magenta, and b* corresponding to amounts of blue and yellow. Negative a* values indicate a green color while positive a* values indicate a magenta color. Negative b* values indicate a blue color and positive b* values indicate a yellow color.

FIG. 5A shows an L* a* b* color space plot indicating how a* and b* values change as a function of applied voltage ranging from 60 volts and 110 volts. As shown, a* values range from about 0 to about −1.3 using applied voltages ranging from 60 volts and 110 volts, corresponding to various amounts of green color. Increasing the voltage from 60 volts to about 100 volts results in increasing amounts of green color. From about 100 volts to about 110 volts, the amount of green lessens slightly. b* values range from about −5.5 to about −0.5 using applied voltages ranging from 60 volts and 110 volts. As indicated, increasing voltage from about 60 volts to about 70 volts results in increasing amounts of blue color. From about 70 volts to about 110 volts, the amount of blue decreases and the amount of yellow increases.

FIG. 5B shows an L* a* b* color space plot indicating how a* and b* values change as a function of applied voltages ranging from 150 volts and 200 volts. As shown, a* values range from about 0 to about 4.2 using applied voltages ranging from 150 volts and 200 volts, corresponding to various amounts of magenta color. From about 150 volts to about 190 volts, the amount of magenta increases, then from about 190 volts to about 200 volts the amount of magenta decreases slightly. b* values range from about 9 to about −8 using applied voltages ranging from 150 volts and 200 volts. As indicated, increasing voltage from 150 volts to 200 volts results in large degreases in the amount of yellow and increases in the amount of blue.

Thus, a porous metal oxide film having various mixtures of green (negative a*), magenta (positive a*), blue (negative b*) and yellow (positive b*) can be accurately controlled by choosing an applied voltage used during the non-dissolution anodizing process. Note that FIGS. 5A and 5B indicate that b* values have a stronger relationship to an applied voltage amount compared to a* values in the voltage ranges between 60 volts and 110 volts and 150 volts and 200 volts. Thus, voltage changes in these ranges results in larger amounts of color shifting between blue and yellow compared to color shifting between green and magenta.

Figure 6:
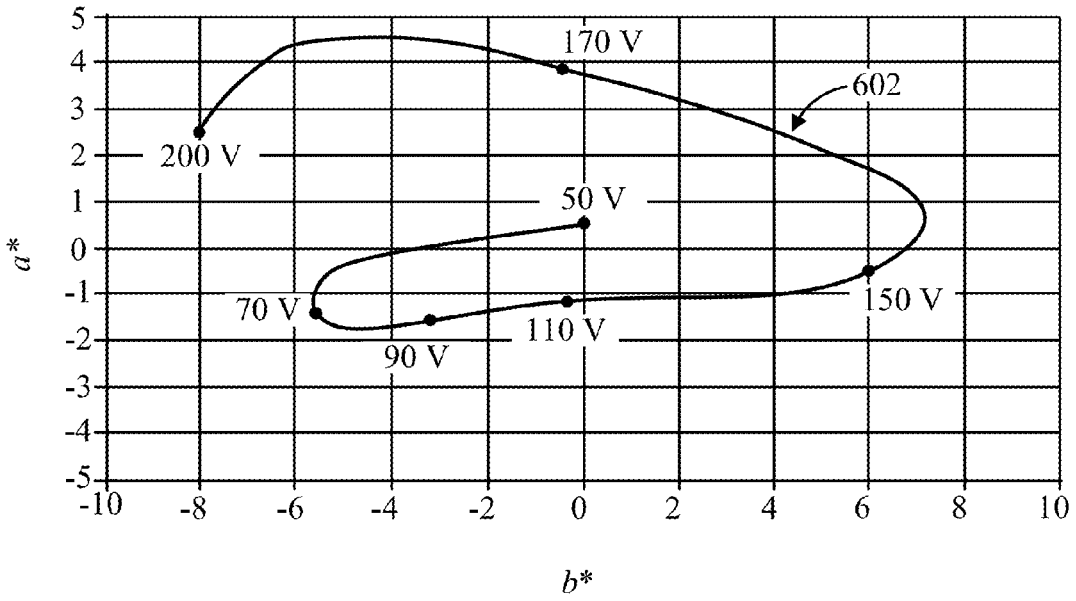
FIG. 6 shows another L* a* b* color space plot indicating how applied voltage can effect a* and b* color opponent dimension values for an interference colored porous aluminum oxide layer formed from an aluminum alloy substrate.

FIG. 6 shows another plot indicating how applied voltage can effect a* and b* color opponent dimension values for an interference colored porous aluminum oxide layer formed from an aluminum alloy substrate. The plot of FIG. 6 shows an L* a* b* color space plot showing b* values (x-axis) with respect to a* values (y-axis). Curve 602 indicates a*/b* values of porous metal oxide layers formed using different voltages, as indicated, during non-dissolution anodizing processes. Moving along the plot in the positive b* direction (right) corresponds to a yellower color, moving in the negative b* direction (left) corresponds to a bluer color, moving in the positive a* direction (up) corresponds to a more magenta color and moving in the negative a* direction (down) corresponds to a greener color. This plot shows that applied voltages around the 60 volt to 80 volt range corresponds to the purest blue color, applied voltages around the 150 volt to 160 volt range corresponds to the purest yellow color and applied voltages around 170 volts corresponds to the purest magenta color.

As mentioned above, techniques described herein can be used to color match different materials. For example, different aluminum alloys can have different colors. These color differences can be attributable to the alloying agents used in the aluminum alloys, such as copper, iron or magnesium. The metal oxide layers formed on different aluminum alloys can also have different colors due to the different alloying agents. For example, most 2000 series and 6000 series aluminum alloys produce a yellowish color—primarily due to the copper content in the alloys, with 2000 series generally producing much yellower color than the 6000 series aluminum alloy. In contrast, some 7000 series aluminum alloys produce a bluer aluminum—especially where copper content is minimal—compared to 6000 and 2000 series aluminum alloys. These color differences can lead to cosmetically unappealing effects on consumer product lines. For example, if a part includes one portion made of a 6000 series aluminum alloy and another portion is made of a 7000 series aluminum alloys, the color difference would likely be very apparent. This may be undesirable in products where metal surfaces are intended to match and look continuous. Similarly, if one part of a product line is made of a 6000 series aluminum alloy while another part from the same product line is made of a 7000 series aluminum alloy, the color difference between the parts would likely be noticeable. This may be undesirable if all parts of a product like are intended to look identical.

Figure 7:
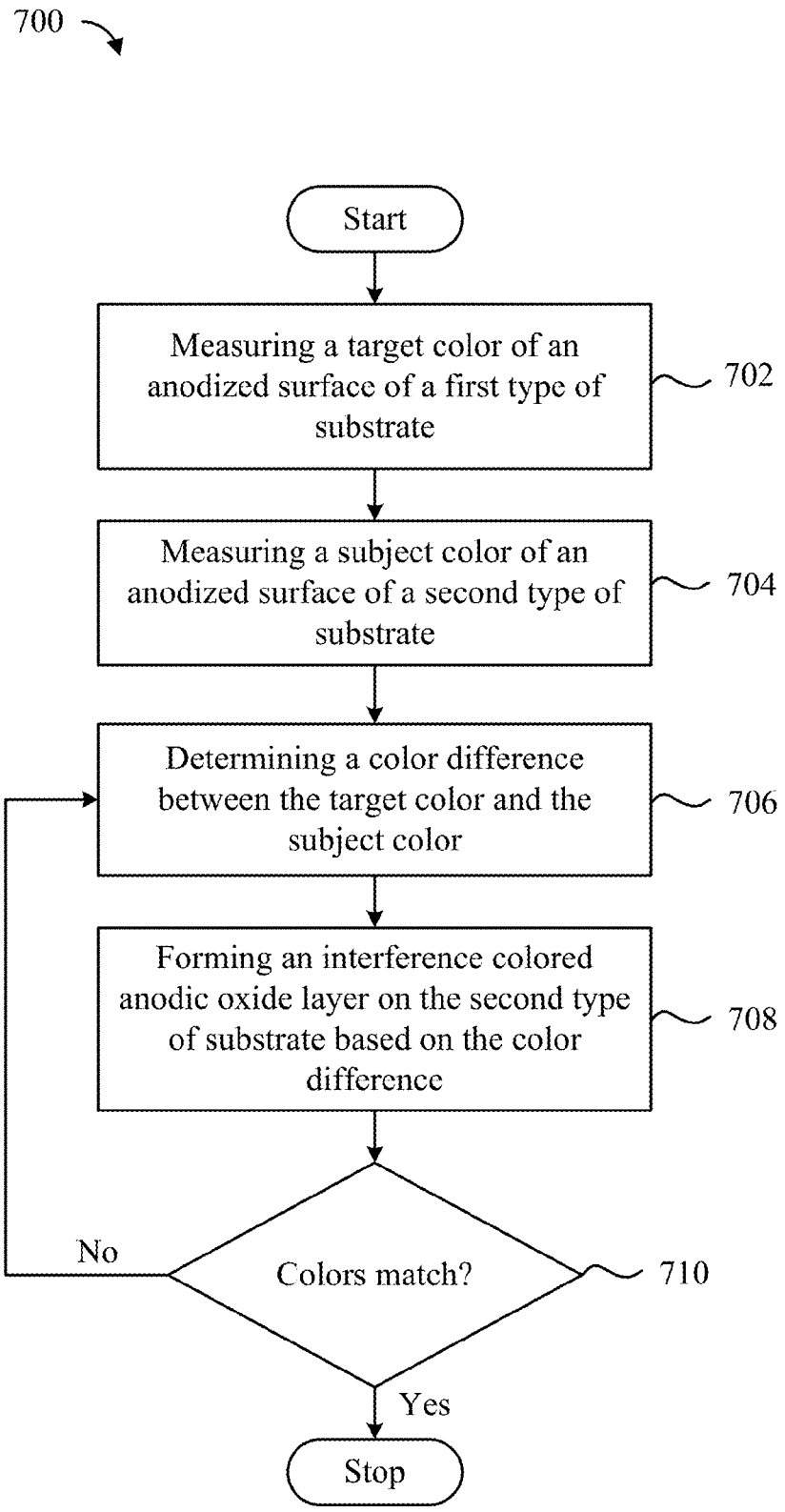
FIG. 7 shows a flowchart that indicates a process for color matching an anodized surface of a first type of substrate with an anodized surface of a second type of substrate.

Methods described herein can be used to color match a first porous metal oxide layer formed on a first type of metal substrate with a second porous metal oxide layer formed on a second type of metal substrate different than the first type of metal substrate. FIG. 7 shows flowchart 700 that indicates a process for color matching an anodized surface of a first type of substrate with an anodized surface of a second type of substrate. The first and second types of substrates can be two different types of metal alloys, such as different alloys of aluminum and/or titanium. At 702, a target color of an anodized surface of the first type of substrate is measured. The target color corresponds to a final color for both porous metal oxide layers on respective substrates. The target color can be measured using any suitable technique, including by way of optical measurement techniques or by visual inspection. In some embodiments, the color is measured using reflectance/transmittance spectral measurements or colorimeter measurements that can assure color accuracy. In some embodiments, the measurements are translated into a color space model, such as an L*, a*, b* color model described above with respect to FIGS. 5A-5B and 6.

At 704, a color of an anodized surface of the second type of substrate is measured. The measurement should be the same measurement technique used to measure the target color at 702 to assure accurate color matching. At 706, a color change required to match the anodized surface of the second type of substrate with the anodized surface of the first type of substrate is estimated. For example, the anodized surface of the first type of substrate may have a bluish hue (e.g., copper-lean aluminum alloy) and the anodized surface of the second type of substrate may have a yellowish hue (e.g., copper-rich aluminum alloy). In this case, the anodized surface of the second type of substrate should be adjusted to have more of a blue color in order to match the anodized surface of the first type of substrate. In some embodiments, the amount of color adjustment required is estimated by comparing reflectance/transmittance spectral measurements of each of the substrate surfaces. In some embodiments, color space models (e.g., L*, a*, b* color models) for each of the substrate surfaces are compared to the estimated the color type (blue, yellow, green, magenta) and amount of adjustment that is required.

At 708, an interference colored metal oxide layer is formed on the second type of substrate based on the determined required color change. That is, the interference colored metal oxide layer adds a color to the second type of substrate such that a final color of the anodized surface of the second type of substrate matches the target color of the anodized surface of the second type of substrate. For example, an interference colored porous metal oxide layer having a yellowish hue can be formed on a copper-lean aluminum alloy substrate in order to match a copper-rich aluminum alloy substrate. Likewise, an interference colored porous metal oxide layer having a bluish hue can be formed on a copper-rich aluminum alloy substrate in order to match a copper-lean aluminum alloy substrate. Note that in some cases the color differences can be quite subtle and require only subtle changes in hue. The interference colored metal oxide layer can be formed using any of the anodizing methods described above. As described above, the color of the interference colored metal oxide layer can be chosen by correlating the required color change with an applied voltage used during a non-porous barrier layer portion. In some embodiments, the intensity of the added color can be increased by increasing the relative intensity of reflection from the pore terminuses, such as by increasing the average pore width using a pore widening process, as described above.

At 710, the final color of the interference colored metal oxide layer formed on the second type of substrate is compared to the target color of the anodized surface of the second type of substrate to determine whether they suitably match. The parameters used to determine whether the final color and target color match and the stringency of the determination will vary depending on application requirements. In some embodiments, the final color and the target color suitably match if they are substantially visually indistinguishable. In some embodiments, the final color and target color suitably match if they have a suitably similar reflectance and/or transmittance spectral measurements. In some embodiments, the final color and target color suitably match if they are characterized similarly on a color space model (e.g., L*, a*, b* color model). If it is determined that the final color and target color match do not suitably match, another color change is estimated at 706, followed by forming an interference colored metal oxide layer based on the estimated color change 708. If it is determined that the final color and target color sufficiently match, process 700 is complete.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A housing for an electronic device, the housing comprising:

an aluminum alloy substrate; and an anodic coating positioned on the aluminum alloy substrate, the anodic coating including:

a porous layer having pores with pore terminuses, and a non-porous barrier layer disposed between the porous layer and the aluminum alloy substrate, the non-porous barrier layer having a thickness defined by the pore terminuses and the aluminum alloy substrate, wherein the thickness of the non-porous barrier layer is configured to impart a color to the anodic coating by thin film interference, the thickness ranging from about 175 nm to about 500 nm, wherein the second color imparted by the non-porous barrier layer is characterized as having a measured b* value ranging between about 0 and about −6 and a measured a* value ranging between about 0 and about −1.5.

2. The housing of claim 1, wherein the aluminum alloy substrate includes at least copper, iron, manganese, chromium or silicon.

3. The housing of claim 1, wherein the color imparted by the non-porous barrier layer is a second color, and at least one alloying element is associated with providing a first color to the anodic coating, the second color is combined with the first color to impart an observed color to the anodic coating.

4. The housing of claim 3, wherein the first color is blue and the second color is yellow.

5. The housing of claim 3, wherein the first color is yellow and the second color is blue.

6. The housing of claim 1, wherein the thickness of the non-porous barrier layer is about 175 nm to about 250 nm.

7. The housing of claim 1, wherein the thickness of the non-porous barrier layer is about 300 nm to about 375 nm.

8. The housing of claim 1, wherein the thickness of the non-porous barrier layer is about 500 nm.

9. The housing of claim 1, wherein the porous layer includes a number of pores, wherein the non-porous barrier layer is laterally continuous with respect to a surface of the aluminum alloy substrate for at least a width of five pores.

10. A housing for an electronic device, the housing comprising:

an aluminum alloy substrate including an alloying agent, the aluminum alloy substrate having an aluminum oxide coating disposed thereon, wherein the alloying agent is associated with providing a first color to the aluminum oxide coating, the aluminum oxide coating comprising:

a porous layer having pores with pore terminuses, and a non-porous barrier layer positioned between the porous layer and the aluminum alloy substrate, the non-porous barrier layer having a thickness defined by the pore terminuses and a surface of the aluminum alloy substrate, wherein the thickness of the non-porous barrier layer is configured to impart a second color to the aluminum oxide coating by thin film interference, wherein the thickness is about 175 nm to about 500 nm, wherein the second color combines with the first color to impart an observed color to the aluminum oxide coating, wherein the second color imparted by the non-porous barrier layer is characterized as having a measured b* value ranging between about 0 and about −6 and a measured a* value ranging between about 0 and about −1.5.

11. The housing of claim 10, wherein the alloying agent includes at least one of iron, copper, manganese, chromium or silicon.

12. The housing of claim 10, wherein the surface of the aluminum alloy substrate is polished, wherein the polished surface is visible through the aluminum oxide coating.

13. The housing of claim 10, wherein the aluminum alloy substrate includes a first amount of an alloying agent, wherein the observed color corresponds to a color of an aluminum oxide coating on a second aluminum alloy substrate having a second amount of the alloying agent, different than the first amount.

* * * * *